United States Patent [19]

Lamb et al.

[11] Patent Number: 4,662,187

[45] Date of Patent: May 5, 1987

[54] AIR CONDITIONING APPARATUS

[75] Inventors: Patrick R. J. Lamb, Crick; Terrance F. Joyce, Northampton; Bernard R. Scouse, Kings Heath, all of England

[73] Assignee: Environheat Limited, Far Cotton, England

[21] Appl. No.: 710,159

[22] Filed: Mar. 11, 1985

[30] Foreign Application Priority Data

Mar. 13, 1984 [GB] United Kingdom ..... 8406501

[51] Int. Cl.[4] ..... F25D 23/06

[52] U.S. Cl. ..... 62/274; 165/60; 237/78 A; 219/362; 219/331

[58] Field of Search ..... 62/91, 304, 263, 274; 165/60; 237/78 R, 78 A; 219/331, 362

[56] References Cited

U.S. PATENT DOCUMENTS 1,966,275 7/1934 Wright ..... 62/91

2,619,802 12/1952 Kline ..... 62/91

*Primary Examiner*—Henry Bennett

*Attorney, Agent, or Firm*—B. J. Powell

[57] ABSTRACT

Air conditioning apparatus (10) comprising a cabinet (12) housing a heat exchanger (42) means (30) to draw ambient air into the cabinet, through the heat exchanger and through main outlet means (22), a steam generator (44) and a vapor mixing chamber (48) within the cabinet, means (50) to supply steam to the mixing chamber in which steam is mixed with ambient air to produce humidified air, and outlet means (54) through which the humidified air is expelled such that mixing with the conditioned air expelled from the main outlet is minimized.

5 Claims, 4 Drawing Figures

AIR CONDITIONING APPARATUS

This invention relates to air conditioning apparatus and more particularly to a compact air conditioning unit which can be wall (or ceiling) mounted and which is adapted to provide a humidified air stream independent from a main conditioned air stream.

Air conditioning units which incorporate a heat exchanger to chill a main air stream and also incorporate a steam generator for humidifying the air stream are known. However, such known systems introduce steam into the main (conditioned) air stream in order to humidify the expelled air. Thus, humidified air cannot be supplied from the unit independently of the main stream. Where chilled air is expelled as the main air stream and steam is introduced into the chilled stream, the air stream expelled contains a high level of visible condensation which is most undesirable for certain environments.

One aspect of the present invention provides air conditioning apparatus comprising a heat exchanger, means to provide a main airstream of conditioned air and means to provide an auxiliary airstream of humidified air and wherein the main airstream and said auxiliary airstream are expelled from the apparatus such that no substantial mixing between those airstreams occurs.

Another aspect of the invention provides air conditioning apparatus comprising a cabinet housing a heat exchanger, means to draw ambient air into the cabinet, and thence force the ambient air through the heat exchanger and from the cabinet through an outlet, a steam generator and a vapour mixing chamber within the cabinet, means to supply steam to the mixing chamber in which the steam is mixed with ambient air drawn into the cabinet to produce humidified air, and outlet means through which the humidified air is expelled, the arrangement being such that mixing of the air stream passed through the heat exchanger with the humidified airstream is minimised.

Yet another aspect of the invention provides in air conditioning apparatus a steam generator for supplying steam to a vapour mixing chamber of the apparatus, said steam generator comprising a container having heating electrodes for boiling water in the container, means for controlling the supply of water to said container and means for controlling drainage of water from said container and wherein said drainage control means is operable in response to a rise in the value of electrical current to said heating electrodes above an upper predetermined value for a predetermined time so that the volume of water held in said container is reduced, whereby the current is restored below said predetermined value and said drainage control means deactivated.

An embodiment of the invention will now be described, by way of example, with reference to the accompanying drawings, in which.

Figure 1:
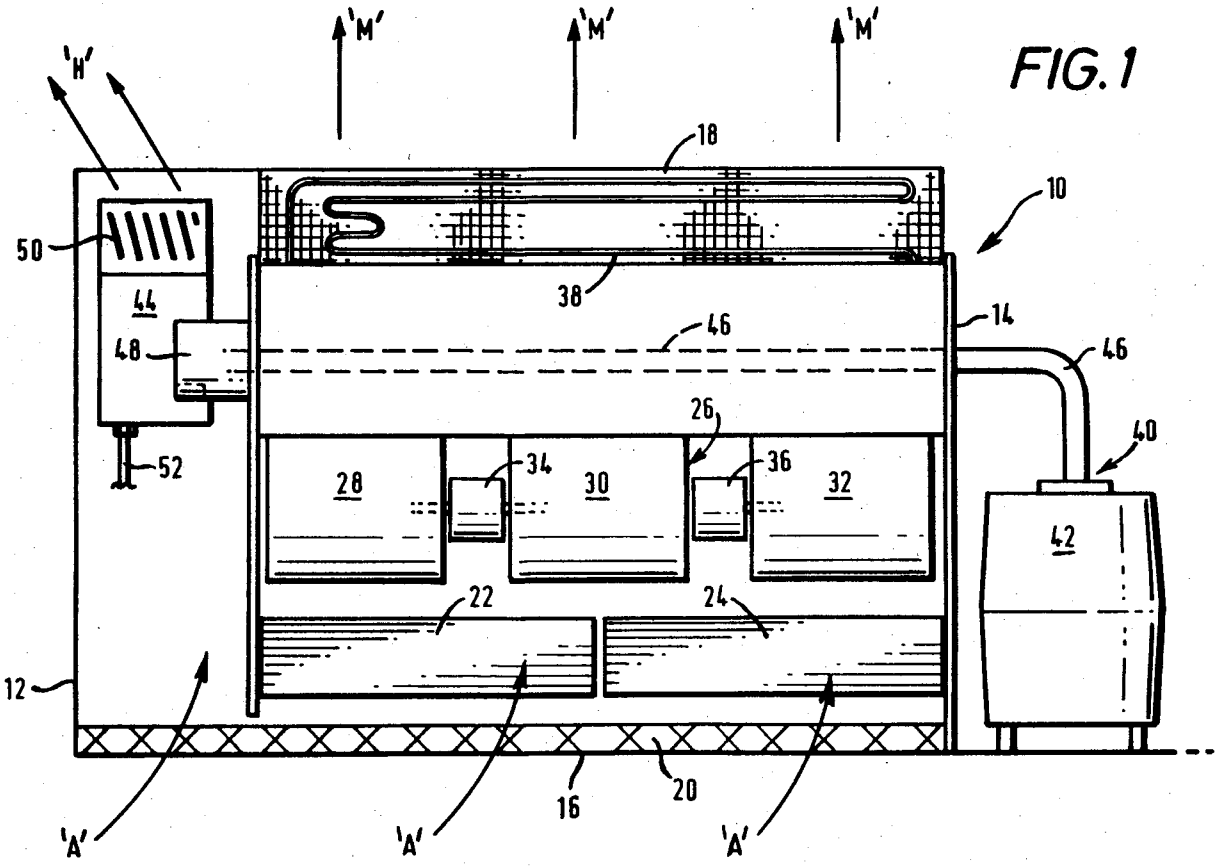
FIG. 1 is a general schematic front elevation of an air conditioning unit according to the invention.

Referring to the drawings there is shown an evaporator room unit 10 comprising cabinet 12 adapted to be fixed to a wall or ceiling or other suitable support structure in a horizontal or vertical position.

The cabinet is mounted on a chassis 14 which also carries substantially all the operating components of the unit and which includes fixing means (not shown) by which the unit is mounted to the support structure. The cabinet incorporates an inlet 16 and an outlet 18 bar frame grille through which air is drawn into and expelled from the unit.

Ambient air 'A' entering the unit first passes through a prefilter 20 extending across the base of the cabinet adjacent inlet grill 16 and which removes the larger airborne particles. The air is then caused to pass through a pair of electrostatic air filtration elements 22 and 24 respectively, which remove airborne particles to 0.05 microns with up to 90% cleaning efficiency. Alternatively, fabric filters (not shown) may be substituted for the electrostatic elements to remove 5 micron particle size at a cleaning efficiency of up to 75–85%.

Air is drawn into the unit by means of a fan assembly 26 disposed above the electrostatic elements and comprising three centrifugal fans 28, 30 and 32 mounted in tandem. Fans 28 and 30 are driven by a double axle electric motor 34 and fan 32 is driven by electric motor 36. The fans force air into a heat exchanger 38 which can either chill or heat the air whereafter the conditioned air is blown through outlet grill 18. Air thermostatic control is included but not shown, to provide for changeover from a cooling mode to a heating mode through a "dead zone" period (having a 2° C. temperature differential) during which time only the axial fans operate. A rotary thermostat operating a phial sensor located in the fan air inlet, also not shown, is connected to a speed control switch to provide for automatic changeover from the cooling mode to the heating mode and vice versa.

Figure 3:
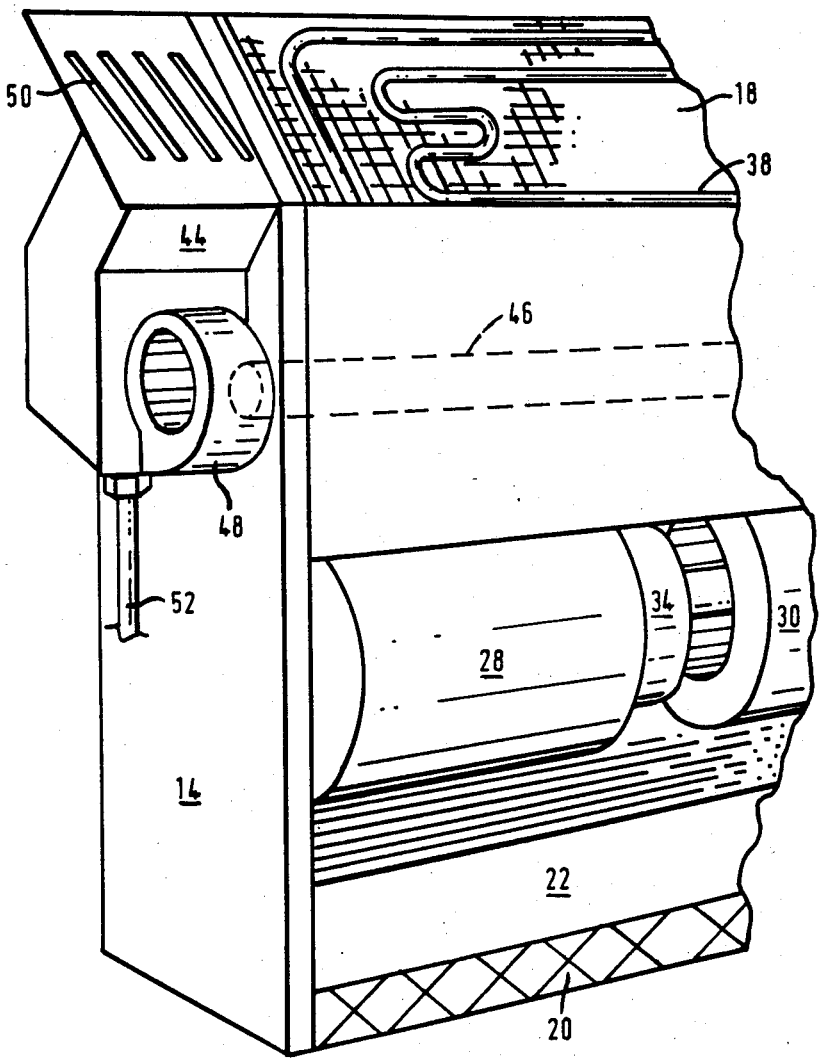
FIG. 3 is a perspective view of a vapour mixing chamber at the opposite end of the unit to the steam boiler assembly.

In order to provide for steam humidification of air, the unit incorporates at one end an electrode boiler assembly 40, which is described in more detail with reference to FIG. 3. The boiler assembly comprises a steam boiler 42 from which steam is transferred to a vapour mixing chamber 44 provided at the opposite end of the cabinet. Steam is transferred by means of a steam pipe 46 which passes through the heat exchanger and terminates at the vapour mixing chamber. A centrifugal fan 48 mounted on the chassis is operative to force ambient air 'A' into the mixing chamber 44 to mix with the steam supplied thereto and then to blow the humidified air 'H' through outlet grille 50 provided at the uppermost end of the mixing chamber. The outlet grille 50 is angled so as to deflect the humidified airstream 'H' away from the main airstream 'M' of conditioned air emitted from outlet grille 18 so that no substantial mixing between these airstreams occurs. Thus, the humdified airstream 'H' is independent of the main airstream 'M' through the evaporator and hence can be operated whenever an increase in humidity is required regardless of the conditioning mode of the main air stream. The ambient air 'A' supplied to the vapour mixing chamber is drawn through the prefilter 20 and via the main inlet grille 16. Mixing chamber 44 is provided with a condensate drain pipe 52.

Figure 2:
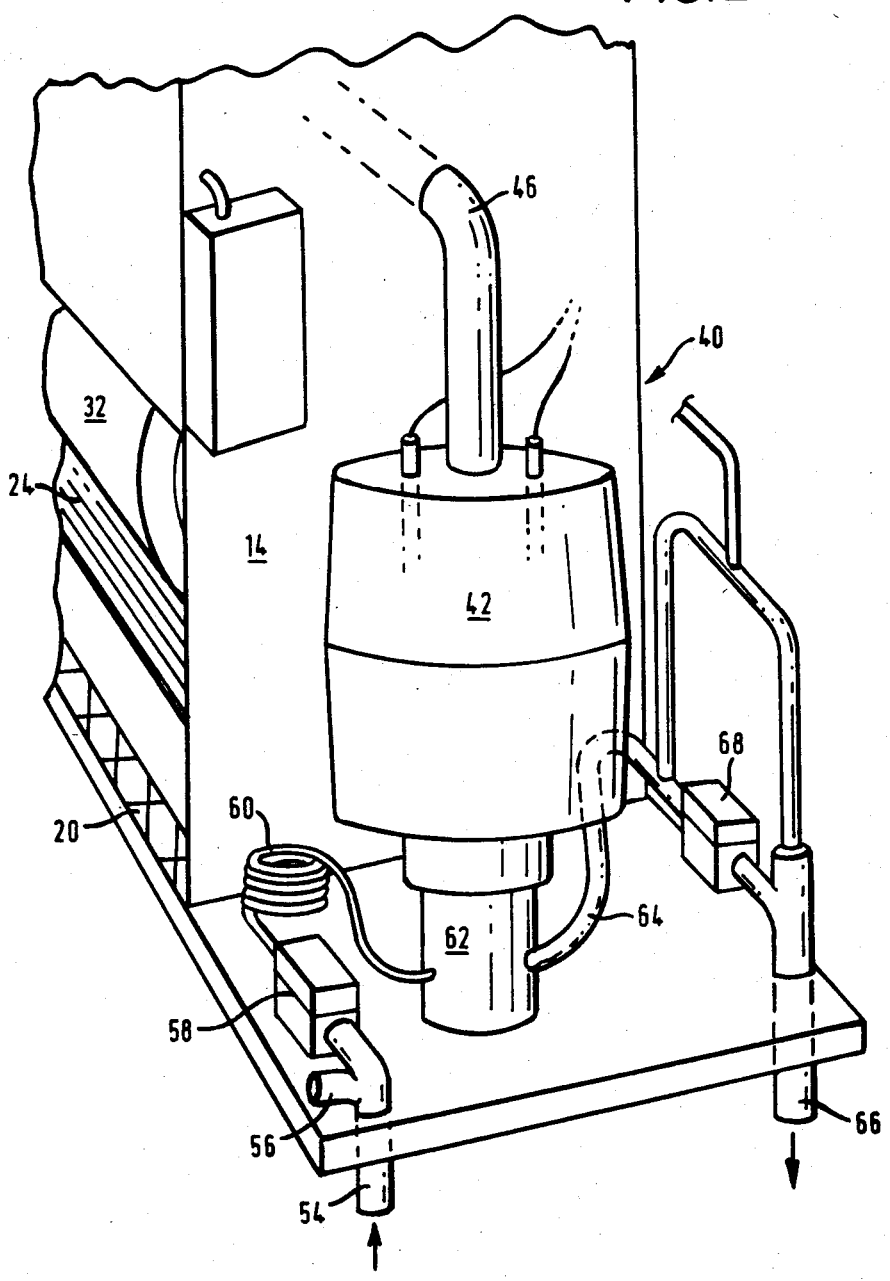
FIG. 2 is a perspective view of a steam boiler assembly at one end of the air conditioning unit.

Referring to FIG. 2, feed water is supplied to the boiler container 42 by a feed pipe 54 which includes a filter, access to which is provided by branch pipe 56. An infeed solenoid valve 58 controls the supply of feed water to a small bore restrictor coil 60 which is connected to a manifold assembly 62 at the base of the boiler container 44. It is envisaged that a pressure regulating valve be interposed between the solenoid valve 58 and the restrictor coil 60 to regulate the feed water pressure within the pressure range of 5–200 lbf/in$^2$.

An outlet pipe 64 communicates the boiler manifold assembly 62 with a drainage pipe 66 via an outfeed solenoid valve 68 which controls output of water from the boiler container.

A 'u'-tube levelling pipe 70 bridges the outfeed solenoid valve 68 and interconnects the outlet pipe and the drain pipe so as to limit the maximum volume of water held in the containers.

Figure 4:
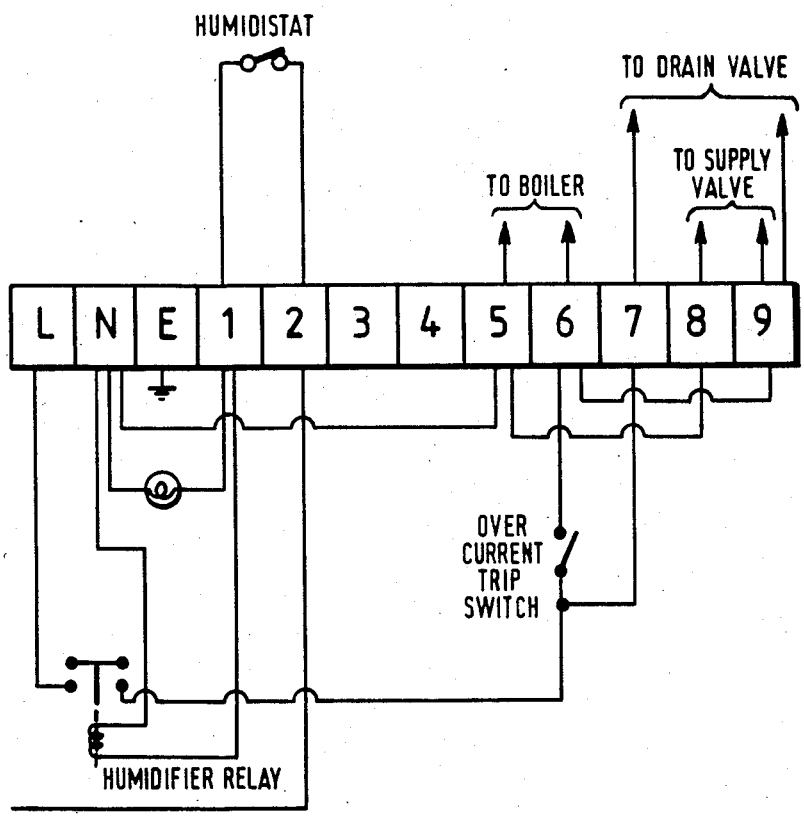
FIG. 4 is an electric circuit diagram showing the control circuit for the steam boiler assembly.

Referring now to both FIGS. 2 and 4, the positive supply from a humidifier relay supplies the live terminal 6 of boiler heating electrodes (not shown) via an overcurrent trip switch 72, when the switch 72 is made. The neutral terminal of the boiler electrodes is designated numeral 5, which also is interconnected with neutral terminal 8 of the infeed solenoid valve. Live terminal 6 is connected to terminal 9 which supplies current to both the infeed and outfeed solenoid valves. Thus, when the overcurrent trip switch 72 is made, terminals 6 and 7 are positive, whereby both terminals 6 and 9 are also positive, so that no voltage is applied to the drain valve which therefore remains closed. The fill valve 58 opens so that the boiler container will fill up to the level of the 'u'-tube pipe 70 with excess fill water draining through pipe 70 and drain pipe 66.

The boiler electrodes heat the water in boiler cylinder 42 and the quantity of dissolved solids in the container increases as water is converted to steam. Hence the current rises to a level which trips the overcurrent trip switch 72 whereby terminal 6 becomes neutral and voltage is applied to the outfeed solenoid valve 68 so that it is opened. Solenoid valve 68 remains open for a period of about 10–15 seconds during which 15–20% of the container contents is drained. As less area of the electrodes is exposed the current drops so that the overcurrent trip switch resets, the solenoid valve 68 is deactivated and normal operation resumes. This cycle of operation will repeat if the water level has not dropped sufficiently and will continue until the current normalises.

We claim:

1. Air conditioning apparatus comprising:

a cabinet defining a main air passage therethrough and having a main inlet thereto and a main outlet therefrom remote from said main inlet;

a heat exchanger positioned in said main air passage intermediate said main inlet and said main outlet;

fan means positioned in said main air passage between said main inlet and said heat exchanger to draw air into said main air passage and thence force the ambient air through said heat exchanger and from said main air passage through said main outlet;

a vapour mixing chamber defined within said cabinet separate from said main air passage and having an auxiliary outlet therefrom separate from said main outlet;

a separate steam generator mounted in said cabinet outside main air passage, said steam generator defining a closed steam chamber therein, electrical electrodes mounted in said steam chamber to boil water and generate steam, a steam outlet pipe communicating with said steam chamber and extending therefrom to the vicinity of said vapor mixing chamber to direct the steam forced from said steam chamber toward said mixing chamber, said steam outlet pipe defining a steam outlet therefrom; and a secondary centrifugal fan having an inlet and an outlet, said fan inlet communicating with both said steam outlet said steam outlet pipe and the ambient air while said fan outlet discharges into said vapour mixing chamber to induce both ambient air and steam from said steam outlet into said vapour mixing chamber so that humidified air is discharged from said auxiliary outlet independently of the air stream passing through said heat exchanger in said main air passage.

2. Air conditioning apparatus according to claim 1 wherein said auxiliary outlet further includes deflection means constructed and arranged so as to deflect the humidified air stream passing out of said auxiliary outlet away from the main air stream passing out of said main outlet.

3. Air conditioning apparatus according to claim 1 wherein said steam generator further comprises:

means for controlling the supply of water to said steam chamber; and drainage control means for controlling the drainage of water from said container, said drainage control means being operable in response to a rise in the value of electrical current passing through said heating electrodes above an upper predetermined value to cause a prescribed volume of water held in said chamber to be drained whereby the electrical current is restored to a lower predetermined value and said drainage control means prevents the flow of water from said chamber.

4. Air conditioning apparatus according to claim 3 wherein said supply control means and said drainage control means each comprises a solenoid operated valve; and, further including a flow restrictor means interposed between said supply control valve and said steam chamber.

5. Air conditioning apparatus according to claim 3 further including a U-shaped pipe bridging said solenoid valve in said drainage control means for limiting the maximum volume of water held in said steam chamber.

* * * * *